US011447316B2

(12) United States Patent
Kurosaki

(10) Patent No.: US 11,447,316 B2
(45) Date of Patent: Sep. 20, 2022

(54) PACKAGED-BODY PRODUCING METHOD

(71) Applicant: CORELEX SHIN-EI CO., LTD., Fuji (JP)

(72) Inventor: Satoshi Kurosaki, Fuji (JP)

(73) Assignee: CORELEX SHIN-EI CO., LTD., Fuji (JP)

( * ) Notice: Subject to any disclaimer, the term of this patent is extended or adjusted under 35 U.S.C. 154(b) by 532 days.

(21) Appl. No.: 16/474,345

(22) PCT Filed: May 19, 2017

(86) PCT No.: PCT/JP2017/018918
§ 371 (c)(1),
(2) Date: Jun. 27, 2019

(87) PCT Pub. No.: WO2018/211710
PCT Pub. Date: Nov. 22, 2018

(65) Prior Publication Data

US 2019/0337695 A1 Nov. 7, 2019

(51) Int. Cl.
*B65D 71/08* (2006.01)
*B65B 11/02* (2006.01)
(Continued)

(52) U.S. Cl.
CPC ..... *B65D 71/08* (2013.01); *B65B 11/02* (2013.01); *B65B 17/02* (2013.01); *B65B 35/50* (2013.01); *B65D 2571/00018* (2013.01)

(58) Field of Classification Search
CPC ..... B65B 11/02; B65B 11/025; B65B 11/585; B65B 17/02; B65B 25/146; B65B 35/50; B65D 71/0088; B65D 71/08
See application file for complete search history.

(56) References Cited

U.S. PATENT DOCUMENTS 2,833,403 A * 5/1958 Benschoter ..... B65D 71/0092 206/597
3,189,175 A * 6/1965 Cruckshank ..... B65D 71/0088 206/322
(Continued)

FOREIGN PATENT DOCUMENTS

CA 2 359 981 A1 4/2002
DE 1 611 865 A1 9/1971
(Continued)

OTHER PUBLICATIONS

Extended European Search Report dated Dec. 18, 2020 in European Application No. 17910243.9.
(Continued)

*Primary Examiner* — Andrew M Tecco
*Assistant Examiner* — Nicholas E Igbokwe
(74) *Attorney, Agent, or Firm* — Sughrue Mion, PLLC

(57) ABSTRACT

A packaged-body producing method that minimizes damage to packaged bodies due to constriction or the like and that enables formation of packaged bodies in various shapes is provided. The method includes a first step in which a plurality of packages 10 accommodating toilet paper rolls or the like are stacked, and recesses are provided at predetermined positions of the stacked form; a second step in which a packaging film 20 is spirally wound on the sides of the package stack form; and a third step in which the packaging film 20 is wound so as to cover the circumference, including an upper end portion and a lower end portion, of the package stack form.

5 Claims, 7 Drawing Sheets

(51) Int. Cl.
*B65B 17/02* (2006.01)
*B65B 35/50* (2006.01)

(56) References Cited

U.S. PATENT DOCUMENTS

| | | | | | |
|---|---|---|---|---|---|
| 3,246,744 | A * | 4/1966 | Marnon | B65D 71/0096 206/386 |
| 3,895,476 | A * | 7/1975 | Burns, III | B65D 71/0096 53/442 |
| 5,195,295 | A * | 3/1993 | Kurosaki | B65D 71/0088 53/399 |
| 5,544,472 | A | 8/1996 | Koskinen et al. | |
| 6,047,523 | A * | 4/2000 | Eyre | B65B 11/025 206/391 |
| 6,471,061 | B1 * | 10/2002 | Teague | B65D 71/0088 206/442 |
| 2010/0313525 | A1 * | 12/2010 | Martin | B65B 41/16 53/461 |
| 2015/0251786 | A1 | 9/2015 | Downhill | |

FOREIGN PATENT DOCUMENTS

| | | | |
|---|---|---|---|
| DE | 24 48 720 | A1 | 4/1975 |
| DE | 41 30 254 01 | | 9/1992 |
| DE | 10 2006 038 996 | B3 | 11/2007 |
| EP | 1 534 603 | A | 6/2005 |
| EP | 1 852 362 | A1 | 11/2007 |
| JP | 04-189764 | A | 7/1992 |
| JP | 07-507028 | A | 8/1995 |
| JP | 2596855 | B2 | 4/1997 |
| JP | 2002-225806 | A | 8/2002 |
| WO | 03/057570 | A2 | 7/2003 |
| WO | 2004/020305 | A1 | 3/2004 |
| WO | 2012/163536 | A1 | 12/2012 |

OTHER PUBLICATIONS

International Search Report for PCT/JP2017/018918 dated Jul. 17, 2017 (PCT/ISA/210).

* cited by examiner

PACKAGED-BODY PRODUCING METHOD

CROSS REFERENCE TO RELATED APPLICATIONS

This application is a National Stage of International Application No. PCT/JP2017/018918 filed May 19, 2017.

TECHNICAL FIELD

The present invention relates to a packaged-body producing method with which a plurality of tissue paper boxes, toilet paper rolls, and the like, which are formed of a tissue material, are packed together, so that these products are in a package form that can be efficiently moved in a warehouse or can be shipped and transported.

BACKGROUND ART

Because individual toilet paper rolls and tissue paper boxes are light in weight, such products are typically transported, traded, or the like in the form of packages containing multiple products.

In particular, when such products are shipped from a factory or are stored in a warehouse, a predetermined number of products are packaged in a cardboard box, and then, a plurality of these cardboard boxes are packed together, thus producing a packaged body, to prevent deformation of the toilet paper rolls and the tissue paper boxes and to increase the efficiency in loading/unloading, transportation, and the like.

As described above, the cardboard boxes accommodating the toilet paper rolls and the tissue paper boxes form packaged bodies, which can be stacked in multiple layers and can be loaded on a pallet to be moved by a forklift truck or the like.

There has been proposed a packaged body that has multiple layers and that has a narrow layer into/from which, for example, fork prongs or the like of a forklift truck can be inserted/removed, so that the packaged body can be moved by a forklift truck without using a pallet or the like (for example, see Patent Literature 1). In this packaged body, a plurality of bands are wound on the outer circumferences of the stacked cardboard boxes to package them together, thus securing the cardboard boxes stacked in multiple layers together so as not to collapse.

CITATION LIST

Patent Literature

[PTL 1]: Japanese Patent No. 2596855

SUMMARY OF INVENTION

Technical Problem

In the related-art packaged bodies, because a stack form is secured by using bands or the like, when toilet paper rolls or tissue paper boxes are packaged, cardboard boxes or the like that are rigid enough to accommodate the toilet paper rolls and the tissue paper boxes are needed to prevent deformation or the like of the toilet paper rolls and the tissue paper boxes. More specifically, when the form of the packaged body is secured by using bands or the like to prevent deformation thereof, portions in contact with the bands may be partially damaged. Hence, cardboard boxes or the like having a certain weight are needed to produce packaged bodies, increasing the distribution cost and the like.

Furthermore, to move the packaged bodies by using a forklift truck or the like, the packaged bodies need to have parts with which the fork prongs or the like of the forklift truck come into contact and which are stably supported by the fork prongs or the like of the forklift truck. Hence, typically, packaged bodies are mounted on a pallet that is configured to be supported by a forklift truck or the like, and the packaged bodies are moved by the forklift truck or the like, together with the pallet. To eliminate the necessity for the pallet, the packaged bodies need to have parts to be supported by the forklift truck or the like, and it has been difficult to secure the shape of the packaged bodies having such parts.

The present invention has been made in view of the above-described circumstances, and an object thereof is to provide a packaged-body producing method that minimizes damage to packaged bodies due to constriction or the like and that enables formation of packaged bodies in various shapes.

Solution to Problem

A packaged-body producing method of the present invention includes:

a first step in which a plurality of packages accommodating toilet paper rolls or tissue paper boxes are stacked, and a package stack form provided with recesses at predetermined positions is formed in the stacked form;

a second step in which a first packaging film is spirally wound on sides of the package stack form; and a third step in which a second packaging film is wound so as to cover the circumference, including an upper end portion and a lower end portion, of the package stack form. In the first step, the plurality of packages are stacked such that the recesses are formed at positions with which fork prongs of a forklift truck can be brought into contact to lift the packages.

In the second step, the first packaging film is tightly secured so as not to prevent the fork prongs of the forklift truck from coming into contact with the recesses and to maintain the package stack form. In the third step, the second packaging film is wound by laying the package stack form on its side so as to allow the recesses to open in a predetermined direction so that the fork prongs of the forklift truck can be inserted therein and so as to generate fixing strength that prevents collapse of the package stack form when lifted by the forklift truck.

Furthermore, in the first step, the package stack form having a rectangular-parallelepiped-shaped upper layer, a narrow layer disposed below the upper layer and having a smaller width than the upper layer, and a first layer disposed below the narrow layer and having a larger width than the narrow layer is formed, and the recesses are provided at both sides of the narrow layer in the width direction. In the third step, the second packaging film is wound on the circumference, including an upper end portion of the upper layer, the both sides of the narrow layer in the width direction, and a lower end portion of the first layer, of the package stack form.

Furthermore, in the third step, the second packaging film having a width equal to or slightly larger than the size of the package stack form in the depth direction, which is perpendicular to the width direction, is disposed such that one end of the second packaging film in the longitudinal direction is below the first layer, and an other end of the second packaging film in the longitudinal direction is moved toward the upper end portion of the upper layer and is wound on the circumference of the package stack form.

Furthermore, in the third step, the second packaging film having a width equal to or slightly larger than the size of the package stack form in the depth direction, which is perpendicular to the width direction, is disposed such that the center of the second packaging film in the longitudinal direction is below the first layer, and both ends of the second packaging film are moved toward the upper end portion of the upper layer and are wound on the circumference of the package stack form.

Furthermore, in the first step, the package stack form having a rectangular-parallelepiped-shaped upper layer, a narrow layer disposed below the upper layer and having a smaller width than the upper layer, and a first layer disposed below the narrow layer and having a larger width than the narrow layer is formed, and the recesses are provided at both sides of the narrow layer in the width direction. In the third step, the second packaging film having the same width as the width of the narrow layer is wound on the circumference, including the upper end portion of the upper layer, a front-side portion having the same width as the width of the narrow layer, a rear-side portion having the same width as the width of the narrow layer, and the lower end portion of the first layer, of the package stack form.

Furthermore, in the first step, the package stack form including a rectangular-parallelepiped-shaped upper layer and a lower layer including a plurality of lower leg parts extending downward from a lower end of the upper layer is formed, and the recesses are provided between the plurality of lower leg parts. In the third step, the second packaging film is wound on the circumference, including an upper end portion of the upper layer and lower end portions of the lower leg parts, of the package stack form.

Advantageous Effects of Invention

The present invention makes it possible to produce packaged bodies in various shapes while preventing deformation during storage and transportation.

DESCRIPTION OF EMBODIMENTS

An embodiment of the present invention will be described below.

It has become possible to produce so-called long-lasting toilet paper rolls, which are formed by winding a long tissue web having a length of 100 m or more while having a roll diameter that complies with JIS standard. The long-lasting toilet paper rolls are suitable for, for example, stockpile in case of a disaster and are now mass-produced and commercially available. Because such long-lasting toilet paper rolls are formed by tightly winding a tissue web, the rolls have a hard and dense roll shape and are rigid enough not to easily deform when subjected to pressure from the outside.

Because such long-lasting toilet paper rolls are unlikely to deform or flatten, the necessity for using strong cardboard boxes when a large number of products are packed together is reduced.

Hence, a plurality of the long-lasting toilet paper rolls are accommodated in a light packaging bag or the like that is made of a plastic film or the like, forming a package, and a plurality of the packages are stacked and secured together, forming a packaged body.

Because this packaged body can reduce the use of cardboard boxes or the like, which have a certain weight, it is possible to reduce the outside dimensions and to produce light-weight products. Furthermore, because it is possible to form packaged bodies in various shapes, it is possible to make moving in a factory or a warehouse using a forklift truck, loading/unloading using a truck, and other tasks easy.

First Embodiment

Figure 1A:
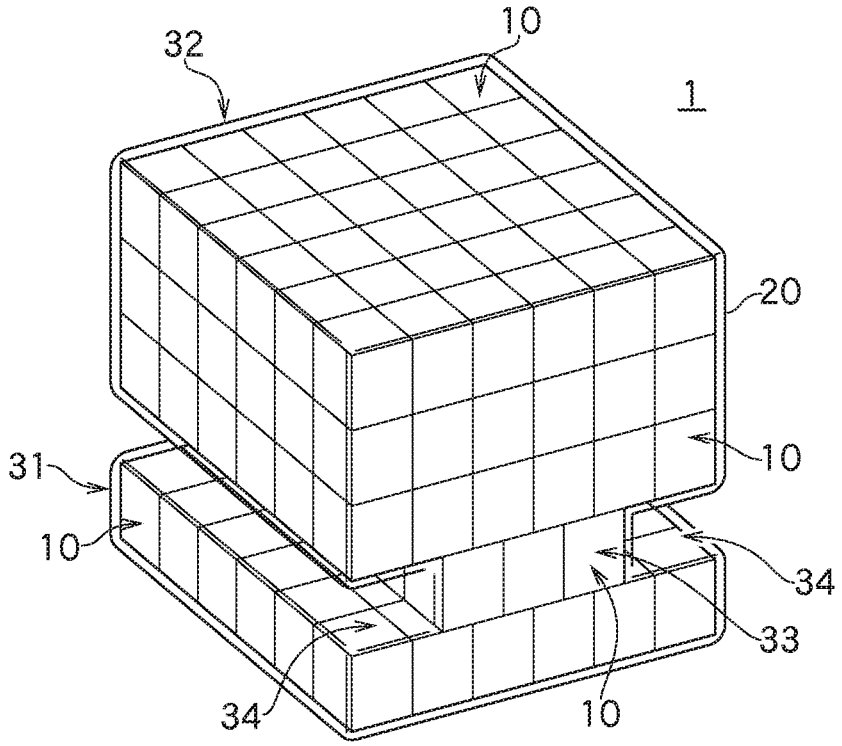
FIG. 1(*a*) and FIG. 1(*b*) are diagrams showing the outline of a packaged body formed by using a packaged-body producing method according to a first embodiment and the like of the present invention, in which FIG. 1(*a*) is a perspective view of a packaged body 1 in which a plurality of toilet paper rolls are packaged, and FIG. 1(*b*) is a perspective view of a package 10 constituting the packaged body 1.
Figure 1B:
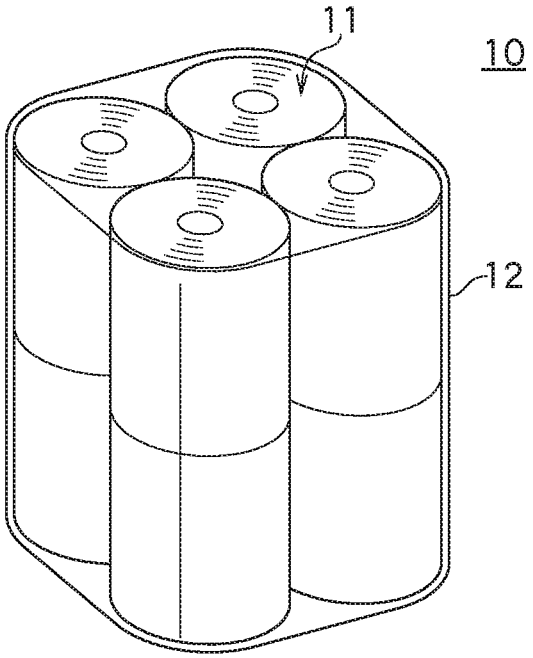

FIGS. 1(*a*) and 1 (*b*) are diagrams showing the outline of a packaged body formed by using a packaged-body producing method according to a first embodiment of the present invention. FIG. 1(*a*) is a perspective view of a packaged body 1 in which a plurality of toilet paper rolls are packaged. FIG. 1(*b*) is a perspective view of a package 10 constituting the packaged body 1.

The packaged body 1 is a package of packages 10 or toilet paper rolls 11 formed by stacking a predetermined number of packages 10 and covering the packages 10 with a packaging film 20, which is a stretch film, for example.

The packaged body 1 described herein has a first layer 31, an upper layer 32, and a narrow layer 33, each including a predetermined number of packages 10 arranged without a space therebetween. Support parts 34, into and with which fork prongs or the like of a forklift truck (not shown) are inserted and brought into contact, are formed at the sides of the narrow layer 33 so as to serve as recesses in the packaged body 1 or a package 10 stack form.

Each package 10 is formed by accommodating eight toilet paper rolls 11 in total, which can be set in typical holders and the like and are arranged such that, for example, two rows of two rolls are stacked in two layers in a storage bag 12 formed of a thin film or the like. Note that the package 10 may be a cardboard box or the like having an appropriate strength, which accommodates a plurality of toilet paper rolls 11, products including a plurality of toilet paper rolls 11 accommodated in storage bags as described above, and tissue paper boxes (not shown).

The toilet paper rolls 11 are, for example, coreless paper rolls formed by winding paper without using cardboard cores and are long-lasting toilet paper rolls formed by winding, while applying a strong tension or the like during winding, a tissue web that is longer than typical toilet paper rolls such that it has the same roll diameter as that of typical toilet paper rolls complying with JIS standard or the like.

Figure 2A:
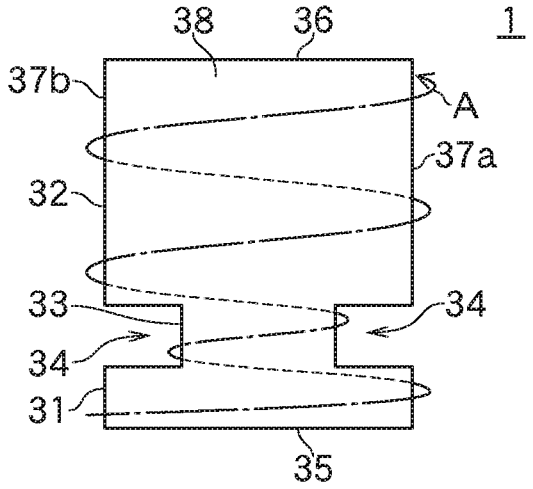
FIG. 2(*a*), FIG. 2(*b*) and FIG. 2(*c*) are diagrams showing the packaged-body producing method according to the first embodiment, in which FIG. 2(*a*) illustrates a packaging film 20 wound in a direction indicated by an arrow A, FIG. 2(*b*) illustrates the packaging film 20 wound in a direction indicated by an arrow B and FIG. 2(*c*) illustrates the packaging film 20 wound in a direction indicated by an arrow C.
Figure 2B:
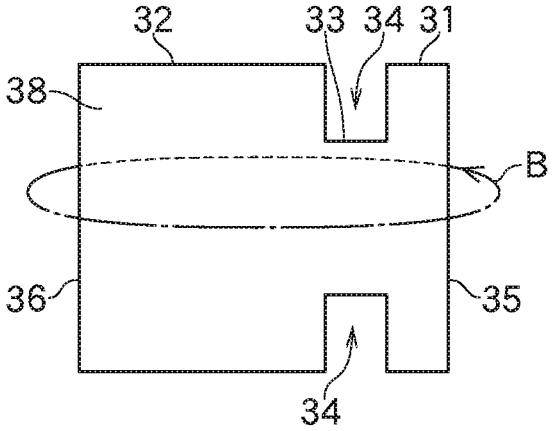
Figure 2C:
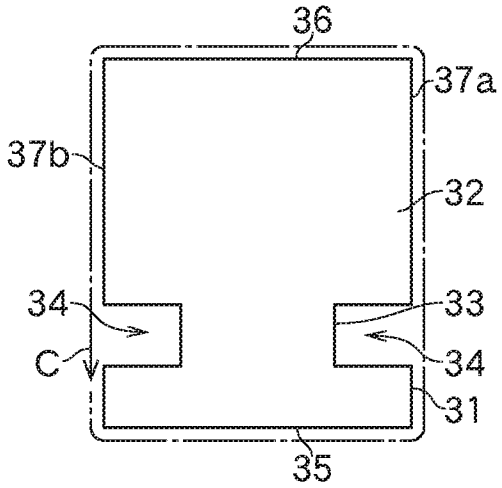

FIGS. 2(*a*)-2(*c*) are diagrams showing the packaged-body producing method according to the first embodiment. FIGS. 2(*a*)-2(*c*) are front views of a front-side portion 38 of the packaged body 1, showing a process of winding the packaging film 20 having a width of, for example, several hundred millimeters around the plurality of packages 10 stacked on one another.

In the first layer 31, which is the lowest layer in the packaged body 1, a predetermined number of packages 10 are arranged in the width direction so as to have a larger width than the narrow layer 33 and so as to have the same width as the upper layer 32 when the packaged body 1 is viewed from the front. Furthermore, the first layer 31 is formed by stacking a predetermined number of packages 10 such that the support parts 34 are formed at a height allowing the fork prongs of the forklift truck or the like to be inserted.

Note that the first layer 31 may be formed not by arranging the packages 10 in multiple layers, but by arranging the packages 10 only in a single layer in the width direction. Note that, in the packaged body 1, that is, the package 10 stack form, an upper end portion 36 of the upper layer 32 is the top surface of the stack form, and the lower end portion of the first layer 31 is the bottom surface of the stack form. Furthermore, side portions 37*a* and 37*b*, which are formed by the upper layer 32, the first layer 31, and the like; the front-side portion 38; a rear-side portion 39; and the like serve as the sides of the packaged body 1 (package stack form).

The narrow layer 33 is formed above the first layer 31. When the front-side portion 38 is viewed from the front, the support parts 34 of the same size are formed on both sides of the narrow layer 33. Specifically, the narrow layer 33 is disposed such that, in the width direction of the front-side portion 38, the center part thereof is at the same position as the center part of the first layer 31 (the center parts are aligned in the top-bottom direction), and, when the front-side portion 38 is viewed from the front, the left and right support parts 34 are symmetrical.

Above the narrow layer 33 is formed the upper layer 32, in which a plurality of packages 10 constituting the upper layer 32 are arranged. In the upper layer 32, for example, as described above, the same number of the packages 10 as in the first layer 31 are arranged in the horizontal direction, which is then stacked in multiple layers to form, for example, a rectangular parallelepiped shape.

Note that the first layer 31, the narrow layer 33, and the upper layer 32 have the number of the packages 10 arranged in the depth direction (not shown in FIGS. 2(*a*)-2(*c*)). Specifically, the first layer 31, the narrow layer 33, and the upper layer 32 have the same sizes (dimensions) in the depth direction of the packaged body 1.

When the packaged body 1 is produced by forming the respective layers in which the above-described number of packages 10 are arranged, for example, first, the packages 10 constituting the first layer 31 are arranged, and then the packaging film 20 is wound obliquely upward from the lower end portion of the first layer 31, that is, so as to spirally cover the side circumference (sides) of the first layer 31, as shown by an arrow A in FIG. 2(*a*).

After the packages 10 that are arranged so as to form the first layer 31 are secured, a predetermined number of packages 10 constituting the narrow layer 33 are arranged and stacked on the upper-end surface of the first layer 31, and the package film 20 wound around the first layer 31 is sequentially wound around the narrow layer 33, thus fixing the narrow layer 33 to the first layer 31.

After the narrow layer 33 is reliably fixed by the packaging film 20 in this way, the packages 10 constituting the upper layer 32 are arranged on the upper end portion of the narrow layer 33.

When the upper layer 32 is stacked on the narrow layer 33, because the recessed support parts 34 are formed at both sides of the narrow layer 33, the packages 10 are stacked in an unstable state. Hence, particularly the packages 10 located in the lowest layer of the upper layer 32 are appropriately wound with the packaging film 20 to be secured as they are stacked on the narrow layer 33, and the upper layer 32 is formed while preventing collapse or the like. The packages 10 are stacked in a predetermined number of layers to form the upper layer 32 in this way, and the packaging film 20 is spirally wound around the upper layer 32 to secure the packages 10.

As described above, when the packaging film 20 is spirally wound, the packaging film 20 is brought into tight contact with the side portions 37*a* and 37*b*, the front-side portion 38 of the packaged body 1, and the rear-side portion 39 of the packaged body 1 (not shown in FIGS. 2(*a*)-2(*c*)) to apply an appropriate pressure to the side portions of the stacked packages 10 to prevent collapse.

In other words, the packaging film 20 is spirally wound so as to cover the overall sides of the first layer 31, the overall sides of the narrow layer 33, and the overall sides of the upper layer 31. At this time, by winding the packaging film 20 while applying an appropriate tension, the packages 10 are tightly secured while covering the side portions of the packaged body 1. Note that, because the packaging film 20 is also in tight contact with the sides of the narrow layer 33, the packaging film 20 covers the overall sides of the packaged body 1 while forming the support parts 34.

In the description above, the packaging film 20 is sequentially wound as the packages 10 are stacked on one another. However, when it is possible to stack the packages 10 such that they do not easily collapse, it is possible to arrange and stack all the packages 10 constituting the packaged body 1 to form the external shape of the packaged body 1 and then wind the packaging film 20 in a single step in the direction indicated by the arrow A in FIG. 2(*a*).

Next, the packaged body 1 around which the packaging film 20 is spirally wound is laid on its side as shown in, for example, FIG. 2(*b*), and then the packaging film 20 is wound in the direction of an arrow B. More specifically, the packaging film 20 is wound so as to continuously surround the upper end portion 36 of the packaged body 1 or the upper layer 32, the front-side portion 38 of the packaged body 1, the lower end portion 35 of the packaged body 1 or the first layer 31, and the rear-side portion 39 of the packaged body 1 (not shown).

Note that, when the packaging film 20 is wound in the direction of the arrow B, the packaging film 20 is wound so as not to extend over the positions where the support parts 34 are formed in the front-side portion 38 and the rear-side portion 39 of the packaged body 1. Specifically, in the front-side portion 38 and the rear-side portion 39, the packaging film 20 is wound so as not to cover both sides of the narrow layer 33 (portions serving as the support parts 34), so that the support parts 34 are open.

Next, the packaging film 20 is wound in the direction indicated by an arrow C in FIG. 2(*c*) to integrally secure the upper layer 32, the narrow layer 33, and the first layer 31 together. When the packaging film 20 is wound in the direction of the arrow C, the packaging film 20 may be wound on all the portions between the front-side portion 38 and the rear-side portion 39 of the packaged body 1, or the packaging film 20 may be wound partially to the extent that the fixing strength that can maintain the shape of the packaged body 1 is obtained. Note that, by winding the packaging film 20 in the direction of the arrow C, the support parts 34 in the side portions 37*a* and 37*b* of the packaged body 1 are covered with the packaging film 20.

The packaging film 20 wound in the direction of the arrow C and the packaging film 20 wound in the direction of the arrow B in FIG. 2(*b*) intersect each other at right angles at the upper end portion 36 and the lower end portion 35 of the packaged body 1.

Note that the packaging film 20 wound in the directions of the arrow B and the arrow C, that is, the packaging film 20 wound on the outer circumference of the packaged body 1 (package stack form) in the top-bottom direction, is wound multiple number of times so as to generate fixing strength that prevents deformation of the packaged body 1 or collapse of the packages 10 occurring when fork prongs or the like of a forklift truck are brought into contact with the support parts 34, and the packaged body 1 is lifted.

Furthermore, also in the respective embodiments described below, the packaging film wound in the same directions as the directions of the arrow B and the arrow C above, that is, the packaging film wound on the outer circumference of the package stack form in the top-bottom direction, is wound an appropriate number of times while an appropriate tension or the like is applied thereto so as to generate fixing strength that prevents deformation or collapse of the shape of the packaged body 1.

Second Embodiment

Figure 3A:
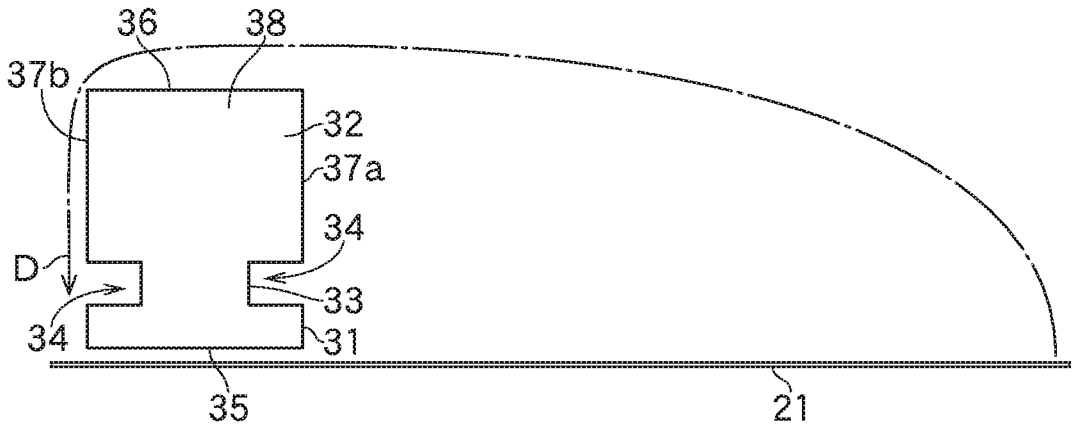
FIG. 3(*a*) and FIG. 3(*b*) are diagrams showing a packaged-body producing method according to a second embodiment of the present invention, in which FIG. 3(*a*) is a front view of a front-side portion 38 of a packaged body 1, and FIG. 3(*b*) is a front view of an upper end portion 36 of the packaged body 1.
Figure 3B:
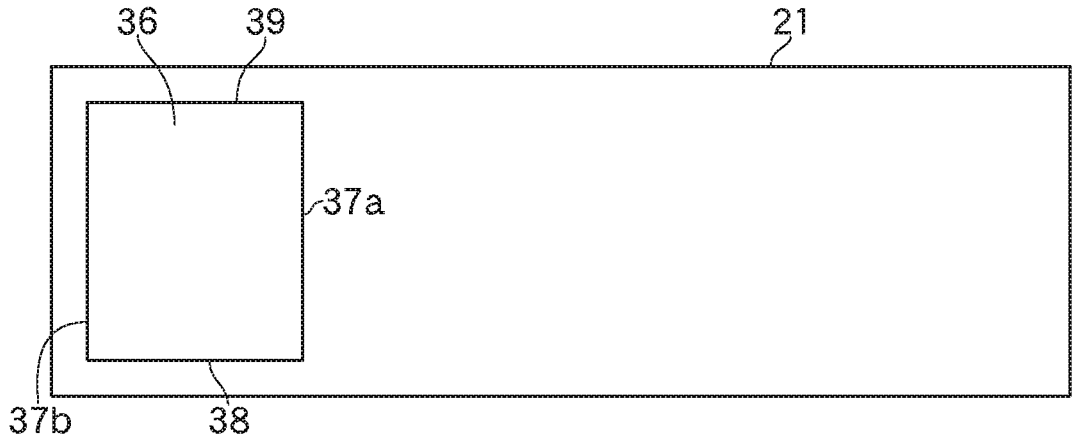

FIGS. 3(*a*) and 3(*b*) are diagrams showing a packaged-body producing method according to a second embodiment of the present invention. FIG. 3(*a*) is a front view of the front-side portion 38 of the packaged body 1, and FIG. 3(*b*) is a front view of the upper end portion 36 of the packaged body 1.

In the production method in the second embodiment, first, as has been described using, for example, FIG. 2(*a*), as the first layer 31, the narrow layer 33, and the upper layer 32 are stacked on one another, the packaging film 20 having a width of several hundred millimeters is spirally wound therearound to secure the stacked layers together so as not to collapse (so as not to be shifted from the positions where they are stacked).

Thereafter, as shown in FIG. 3(*a*), a packaging film 21 is disposed below the first layer 31 or the lower end portion 35. The packaging film 21 is, for example, a thin film that is made of a material similar to the material of the packaging film 20. The packaging film 21 has a film width that is equal to or slightly larger than the depth dimension of the packaged body 1 (the package 10 stack form) and a length in the longitudinal direction of, at least, a length with which the outer circumferences of the sides of the packaged body 1, that is, the side portion 37*a*, the upper end portion 36, the side portion 37*b*, and the lower end portion 35, can be continuously covered. Note that the thickness and the material of the packaging film 21 do not need to be the same as those of the packaging film 20.

The packaged body 1 (package stack form) around which the packaging film 20 is spirally wound as shown in FIG. 2(*a*) is disposed or placed at one end of the packaging film 21 in the longitudinal direction, as shown in FIGS. 3(*a*) and 3(*b*). With the packaged body 1 disposed like this, the other end of the packaging film 21 in the longitudinal direction is wound around the side circumferences (outer circumferences in the top-bottom direction) of the packaged body 1 by moving the other end so as to be directed toward the upper end portion 36 of the packaged body 1, to cover the side portion 37*b*, and to reach the lower end portion 35, as shown by an arrow D in FIG. 3(*a*).

When the packaging film 21 is wound this way, the support parts 34 are covered with the packaging film 21 at the side portion 37*a* and the side portion 37*b*, and the support parts 34 are open at the front-side portion 36 and the rear-side portion 39. Note that, depending on the strength of the packaging film 21, the weight of the packaged body 1, or other factors, the packaging film 21 may be wound multiple number of times so as to generate fixing strength that prevents, when lifted by a forklift truck or the like, deformation or collapse of the shape of the packaged body 1, that is, the shape in which the first layer 32, the narrow layer 33, and the upper layer 32 are stacked, and the support parts 34 are formed.

Third Embodiment

Figure 4A:
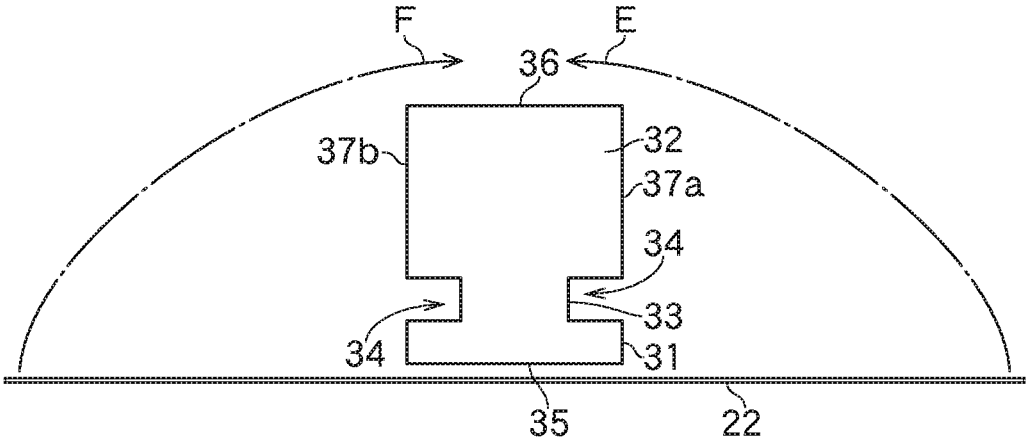
FIG. 4(*a*) and FIG. 4(*b*) are diagrams showing a packaged-body producing method according to a third embodiment of the present invention, in which FIG. 4(*a*) is a front view of the front-side portion 38 of the packaged body 1, and FIG. 4(*b*) is a front view of the upper end portion 36 of the packaged body 1.
Figure 4B:
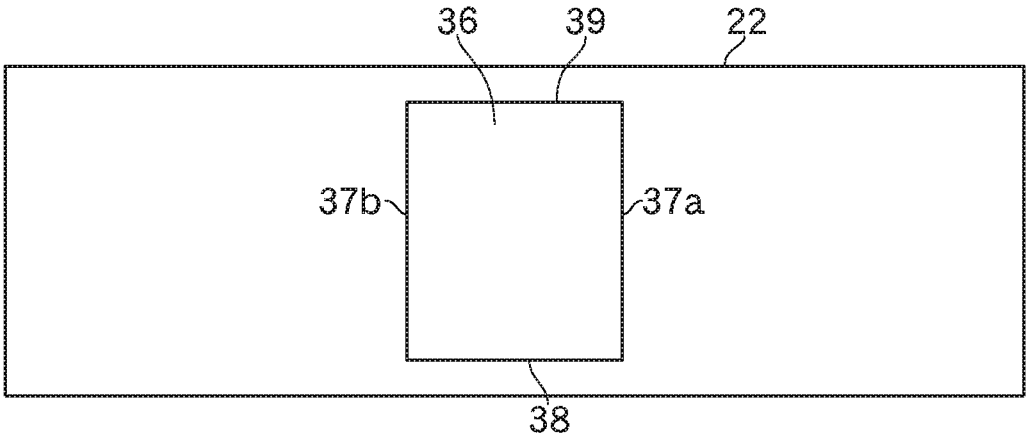

FIGS. 4(*a*) and 4(*b*) are diagrams showing a packaged-body producing method according to a third embodiment of the present invention. FIG. 4(*a*) is a front view of the front-side portion 38 of the packaged body 1, and FIG. 4(*b*) is a front view of the upper end portion 36 of the packaged body 1.

In the production method in the third embodiment, first, as has been described using, for example, FIG. 2(*a*), as the first layer 31, the narrow layer 33, and the upper layer 32 are stacked on one another, the packaging film 20 having a width of several hundred millimeters is spirally wound therearound to secure the stacked layers together so as not to collapse (so as not to be shifted from the positions where they are stacked).

Thereafter, as shown in FIG. 4(*a*), a packaging film 22 is disposed below the first layer 31 or the lower end portion 35. The packaging film 22 is, for example, a thin film that is made of a material similar to the material of the packaging film 20. The packaging film 22 has a width that is equal to or slightly larger than the depth dimension of the packaged body 1 (package stack form) and has a length in the longitudinal direction of, at least, a length capable of continuously covering the outer circumferences of the sides of the packaged body 1 or the like, that is, the side portion 37*a*, the upper end portion 36, the side portion 37*b*, and the lower end portion 35. Note that the thickness and the material of the packaging film 22 do not need to be the same as those of the packaging film 20.

The packaged body 1 (package stack form) around which the packaging film 20 is spirally wound, as shown in FIG. 2(*a*), is disposed or placed at the central portion of the packaging film 22 in the longitudinal direction, as shown in FIGS. 4(*a*) and 4(*b*). With the packaged body 1 placed like this, one end and the other end of the packaging film 22 in the longitudinal direction are wound such that the one end is moved toward the upper end portion 36 of the packaged body 1 in the direction indicated by an arrow E in FIG. 4(*a*) to cover the side portion 37*a* and the upper end portion and such that the other end is moved toward the upper end portion 36 in the direction indicated by an arrow F in FIG. 4(*a*) to cover the side portion 37*b* and the upper end portion 36.

When the packaging film 22 is wound this way, the support parts 34 are covered with the packaging film 22 at the side portion 37*a* and the side portion 37*b*, and the support parts 34 are open at the front-side portion 36 and the rear-side portion 39.

Fourth Embodiment

Figure 5:
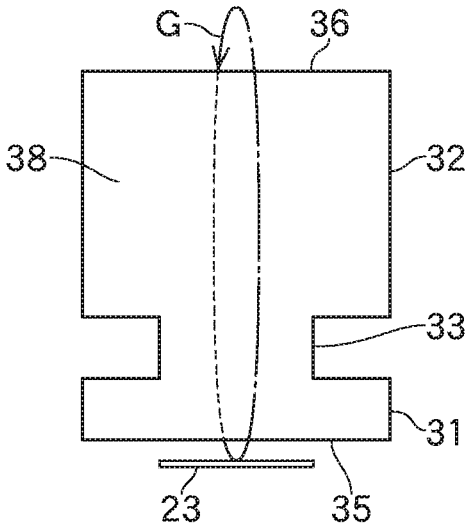
FIG. 5 is a diagram showing a packaged-body producing method according to a fourth embodiment of the present invention.

FIG. 5 is a diagram showing a packaged-body producing method according to a fourth embodiment of the present invention. FIG. 5 is a front view of the front-side portion 38 of the packaged body 1, showing a state in which a packaging film 23 is disposed below the first layer 31 or the lower end portion 35. In the production method in the fourth embodiment, first, as has been described using, for example, FIG. 2(*a*), as the first layer 31, the narrow layer 33, and the upper layer 32 are stacked on one another, the packaging film 20 having a width of several hundred millimeters is spirally wound therearound to secure the stacked layers together so as not to collapse (so as not to be shifted from the positions where they are stacked).

Thereafter, a packaging film 23 having the same width as the narrow layer 33 when the front-side portion 38 and the like are viewed from the front is disposed below, for example, the lower end portion 35 as described above, the width-wise ends of the packaging film 23 and the side ends of the narrow layer 33 (the boundary portions between the narrow layer 33 and the support parts 34) are aligned, and the packaging film 23 is wound in the direction of an arrow G shown in FIG. 5.

Specifically, the packaging film 23 is continuously wound around the front-side portion 38, the upper end portion 36, the rear-side portion 39 (not shown), and the lower end portion 35. At this time, the packaging film 23 is wound so as not to cover the support parts 34 at the front-side portion 38 and the rear-side portion 39.

Note that the thickness and the material of the packaging film 23 do not need to be the same as those of the packaging film 20. Depending on the strength of the packaging film 23, the weight of the packaged body 1, or other factors, the packaging film 23 may be wound multiple number of times so as to generate fixing strength that prevents deformation or collapse of the shape of the packaged body 1 (package stack form) when lifted by a forklift truck or the like.

Fifth Embodiment

Figure 6A:
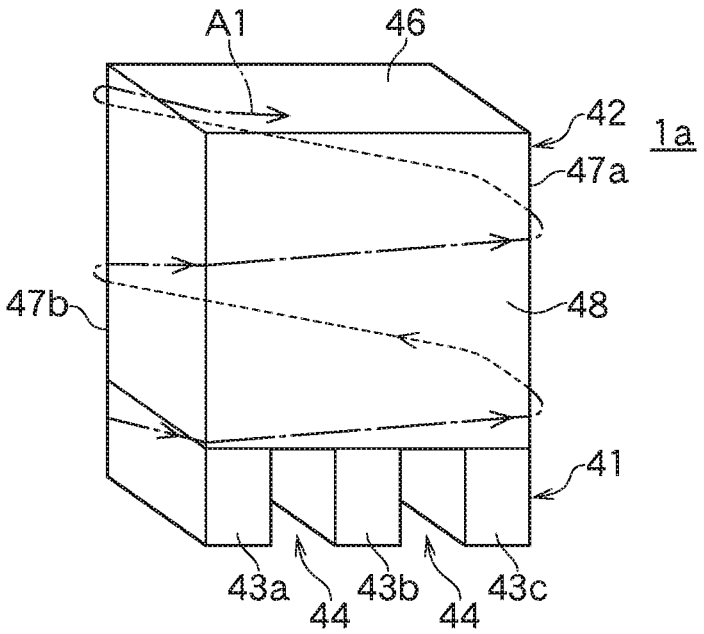
FIG. 6(*a*) and FIG. 6(*b*) are diagrams showing a packaged-body producing method according to a fifth embodiment of the present invention, in which FIG. 6(*a*) is a perspective view of the packaged body 1*a*, and FIG. 6(*b*) is a plan view showing a state in which a packaging film is wound.
Figure 6B:
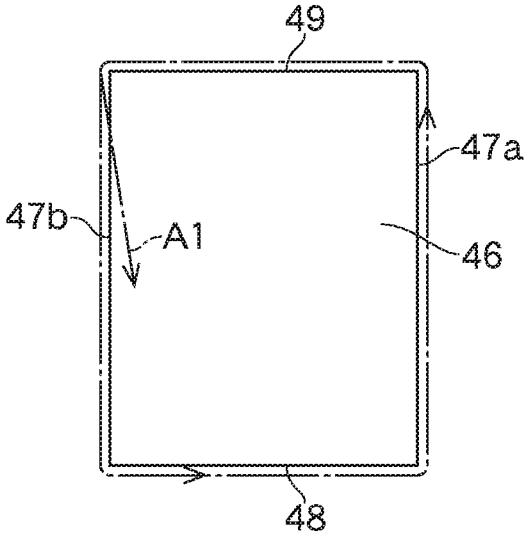
Figure 7A:
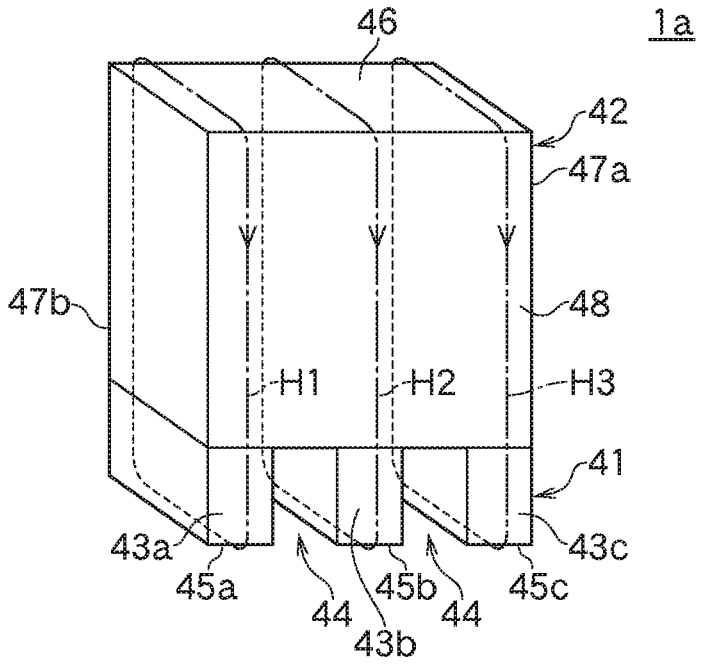
FIG. 7(*a*) and FIG. 7(*b*) are diagrams showing a packaged-body producing method according to the fifth embodiment of the present invention, in which 7(a) is a perspective view of the packaged body 1*a*, and 7(*b*) is a plan view showing a state in which a packaging film is wound.
Figure 7B:
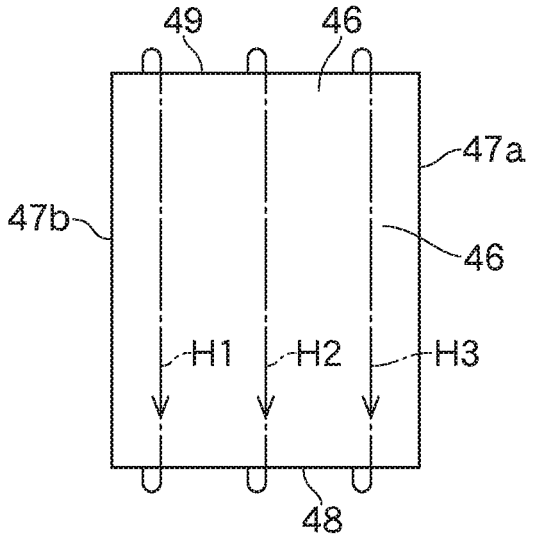

FIGS. 6 and 7 include diagrams showing a packaged-body producing method according to a fifth embodiment of the present invention. A packaged body 1*a* (package stack form) according to the fifth embodiment, as shown in FIGS. 6 and 7, has a lower layer 41 and an upper layer 42 that is stacked on the lower layer 41.

FIGS. 6(*a*) and 7(*a*) are perspective views of the packaged body 1*a*, and FIGS. 6(*b*) and 7(*b*) are plan views showing a state in which a packaging film is wound when an upper end portion 46 of the packaged body 1*a* is viewed from the front.

Similarly to the upper layer 32 of the packaged body 1 described in the above-described first embodiment and the like, the upper layer 42 includes a plurality of packages 10 (not shown) arranged in the horizontal direction, which is then stacked to form, for example, a rectangular parallelepiped shape.

The lower layer 41 has a plurality of lower leg parts 43*a* to 43*c* each formed by arranging a predetermined number of packages 10. Support parts 44, serving as recesses in the packaged body 1*a*, are formed between the lower leg parts.

The support parts 44 are provided at, at least, two positions with an appropriate distance therebetween and have such a shape and size that fork prongs or the like of the forklift truck (not shown) can be inserted therein and brought into contact therewith. Furthermore, the support parts 44 are recesses that are open downward in the lower layer 41 and that extend in the in-plane direction of side portions 47*a* and 47*b*. The support parts 44 are also open in a front-side portion 48 and a rear-side portion 49 of the packaged body 1*a* or the like, that is, are open to the sides of the packaged body 1*a*.

In other words, the lower leg parts 43*a* to 43*c* are projections projecting from a lower layer 41 and are provided, at the lower end of the packaged body 1*a*, so as to extend between the front-side portion 48 and the rear-side portion 49, that is, in the depth direction of the packaged body 1*a* (package stack form).

In the packaged body 1*a* shown as an example herein, the lower leg part 43*a* is provided so as to be flush with the side portion 47*b*, and the lower leg part 43*c* is provided so as to be flush with the side portion 47*a*. Specifically, the lower leg part 43*a* is provided at one side end of the upper layer 42, the lower leg part 43*c* is provided at the other side end of the upper layer 42, and the lower leg part 43*b* is provided between the lower leg part 43*a* and the lower leg part 43*c*.

The packaged body 1*a* has such a shape that the rectangular-parallelepiped-shaped upper layer 42 is supported by the three lower leg parts 43*a* to 43*c* from below. For example, by winding the packaging film 20 (not shown) having a width described in the first embodiment in the manner described below, the packages 10 are secured together to maintain the above-described shape.

When the packaged body 1*a* is produced, a predetermined number of packages 10 are arranged and stacked to form the lower layer 41 and the upper layer 42, and then the packaging film 20 is wound in, for example, the direction indicated by an arrow Al in FIGS. 6(*a*) and 6(*b*) or the like. Specifically, the packaging film 20 is spirally wound from the bottom to the top to cover the sides (the side portions 47*a* and 47*b*, the front-side portion 48, and the rear-side portion 49) of the packaged body 1*a*, that is, the package stack form.

At this time, the packaging film 20 is spirally wound so as not to close the support parts 44, which are open, in the front-side portion 48 and, preferably, also in the rear-side portion 49. When it is difficult to stack the packages 10 constituting the upper layer 42 on the packages 10 constituting the lower leg parts 43*a* to 43*c* of the lower layer 41, the packaged body 1*a* (package stack form) may be formed such that the upper layer 42 is formed first by arranging and stacking a predetermined number of packages, the packaging film 20 is spirally wound therearound, and the upper layer 42 is placed on the lower leg parts 43*a* to 43*c*.

The packaging film 20 is wound on the lower leg parts 43*a* to 43*c*, disposed at the lower end of the upper layer 42, in the directions indicated by arrows H1 to H3 in FIGS. 7(*a*) and 7(*b*) to fix the lower leg parts 43*a* to 43*c* to the upper layer 42.

More specifically, the packaging film 20 is wound in the direction indicated by the arrow H1, on the circumference of the packaged body 1*a* (package stack form), which includes a lower end portion 45*a* of the lower leg part 43*a*, the front-side portion 48, the upper end portion 46, and the rear-side portion 49 of the packaged body 1*a* (package stack form).

Furthermore, the packaging film 20 is wound in the direction indicated by the arrow H2, on the circumference of the packaged body 1*a* (package stack form), which includes a lower end portion 45*b* of the lower leg part 43*b*, the front-side portion 48, the upper end portion 46, and the rear-side portion 49 of the packaged body 1*a* (package stack form).

Furthermore, the packaging film 20 is wound in the direction indicated by the arrow H3, on the circumference of the packaged body 1*a* (package stack form), which includes a lower end portion 45*c* of the lower leg part 43*c*, the front-side portion 48, the upper end portion 46, and the rear-side portion 49 of the packaged body 1*a* (package stack form).

By winding the packaging film 20 on each of the lower leg parts 43*a* to 43*c*, the lower leg parts 43*a* to 43*c* are fixed to the lower end of the upper layer 42.

Note that, the packaging film 20 is wound on each of the lower end portions 45*a* to 45*c* so as not to extend over the support part 44 provided between the lower leg part 43*a* and the lower leg part 43*b*. Furthermore, the packaging film 20 is wound so as not to extend over the support part 44 provided between the lower leg part 43*b* and the lower leg part 43*c*, and thus, the packaging film 20 is wound such that the support parts 44 are open in the front-side portion 48 and, preferably, also in the rear-side portion 49 of the packaged body 1*a* so that fork prongs or the like of the forklift truck can be inserted therein. Furthermore, when the packaging film 20 is wound on the outer circumferences of the packaged body 1*a* in the top-bottom direction, that is, when the packaging film 20 is wound on each of the lower leg parts 43*a* to 43*c*, together with the upper end portion 46, the front-side portion 48, and the rear-side portion 49 of the upper layer 42, depending on the strength of the packaging film 20, the weight of the packaged body 1*a*, or other factors, the packaging film 20 is wound an appropriate number of times so as to generate fixing strength that prevents deformation or collapse of the form of the packaged body 1*a* (package stack form) when lifted by a forklift truck or the like.

REFERENCE SIGNS LIST

1, 1*a* packaged body
10 package
11 toilet paper roll
12 storage bag
20 to 23 packaging film
31 first layer
32, 42 upper layer
33 narrow layer
34, 44 support part
35, 45*a*, 45*b*, 45*c* lower end portion
36, 46 upper end portion
37*a*, 37*b*, 47*a*, 47*b* side portion
38, 48 front-side portion
39, 49 rear-side portion
41 lower layer
43*a*, 43*b*, 43*c* lower leg part

The invention claimed is:

1. A packaged-body producing method comprising:

a first step in which a plurality of packages accommodating toilet paper rolls or tissue paper boxes are stacked, and a package stack form provided with recesses at predetermined positions is formed in the stacked form;

a second step in which a first packaging film is spirally wound on sides of a package stack form;

and a third step in which a second packaging film is wound so as to cover a circumference, including an upper end portion and a lower end portion, of a package stack form, wherein, in the first step, the plurality of packages are stacked such that the recesses are formed at positions with which fork prongs of a forklift truck can be brought into contact to lift the packages, in the second step, the first packaging film is tightly secured so as not to prevent the fork prongs of the forklift truck from coming into contact with the recesses and to maintain the package stack form, and, in the third step, the second packaging film is wound by laying the package stack form on its side so as to allow the recesses to open in a predetermined direction so that the fork prongs of the forklift truck can be inserted therein and so as to generate fixing strength that prevents collapse of the package stack form when lifted by the forklift truck.

2. The packaged-body producing method according to claim 1, wherein, in the first step, the package stack form having a rectangular-parallelepiped-shaped upper layer, a narrow layer disposed below the upper layer and having a smaller width than the upper layer, and a first layer disposed below the narrow layer and having a larger width than the narrow layer is formed, and the recesses are provided at both sides of the narrow layer in the width direction, and, in the third step, the second packaging film is wound on a circumference, including an upper end portion of the upper layer, the both sides of the narrow layer in the width direction, and a lower end portion of the first layer, of the package stack form.

3. The packaged-body producing method according to claim 2, wherein, in the third step, the second packaging film having a width equal to or slightly larger than a size of the package stack form in the depth direction, which is perpendicular to the width direction, is disposed such that one end of the second packaging film in a longitudinal direction is below the first layer, and an other end of the second packaging film in a longitudinal direction is moved toward an upper end portion of the upper layer and is wound on the circumference of the package stack form.

4. The packaged-body producing method according to claim 2, wherein, in the third step, the second packaging film having a width equal to or slightly larger than the size of the package stack form in the depth direction, which is perpendicular to the width direction, is disposed such that the center of the second packaging film in the longitudinal direction is below the first layer, and both ends of the second packaging film are moved toward the upper end portion of the upper layer and are wound on a circumference of the package stack form.

5. The packaged-body producing method according to claim 1, wherein, in the first step, the package stack form having a rectangular-parallelepiped-shaped upper layer, a narrow layer disposed below the upper layer and having a smaller width than the upper layer, and a first layer disposed below the narrow layer and having a larger width than the narrow layer is formed, and the recesses are provided at both sides of the narrow layer in the width direction, and, in the third step, the second packaging film having the same width as the width of the narrow layer is wound on a circumference, including the upper end portion of the upper layer, a front-side portion having the same width as the width of the narrow layer, a rear-side portion having the same width as the width of the narrow layer, and the lower end portion of the first layer, of the package stack form.

* * * * *